United States Patent [19]

D'Annessa et al.

[11] 3,936,128

[45] Feb. 3, 1976

[54] SOLDERLESS ELECTRICAL CONNECTOR FOR CONNECTING A PLURALITY OF INSULATED WIRES

[75] Inventors: Anthony Thomas D'Annessa, Marietta, Ga.; Paul Rudolph Gustin, Baltimore, Md.; Donald Tolman Smith, Norcross; Janis John Zalmans, Atlanta, both of Ga.

[73] Assignees: Bell Telephone Laboratories, Incorporated, Murray Hill, N.J.; Western Electric Company, New York, N.Y.

[22] Filed: Jan. 31, 1975

[21] Appl. No.: 545,816

[52] U.S. Cl. ..... 339/98; 339/103 M

[51] Int. Cl.[2] ..... H01R 13/38

[58] Field of Search ..... 339/97–99, 339/103

[56] References Cited

UNITED STATES PATENTS

| | | | |
|---|---|---|---|
| 3,511,921 | 5/1970 | Pasternak | 174/88 |
| 3,718,888 | 2/1973 | Pasternak | 339/98 |
| 3,890,029 | 6/1975 | Izraeli | 339/98 |

*Primary Examiner*—Joseph H. McGlynn
*Attorney, Agent, or Firm*—C. E. Graves

[57] ABSTRACT

A solderless electrical connector is disclosed having the capability of connecting a plurality of insulated wires. The connector includes a metallic contact having a plurality of keyhole-shaped slots. As the wire is inserted, the mouths and associated shoulders of these slots pierce and strip the insulation from the conductor. As the wire is forced further into the keyhole slot, the inner walls of the slot are caused to bear into the surface of the conductor. The connector further includes a means for positioning and retaining the wires to be interconnected, a means for enclosing the connection, and a means for protecting the connection from torsional and tensional stresses.

12 Claims, 11 Drawing Figures

SOLDERLESS ELECTRICAL CONNECTOR FOR CONNECTING A PLURALITY OF INSULATED WIRES

FIELD OF THE INVENTION

This invention relates to solderless electrical connectors and particularly to such connectors utilized to interconnect or splice two or more insulated wires together.

BACKGROUND OF THE INVENTION

One type of solderless connector is made up of a base, a contact, and a cap. This type is exemplified in the teaching of J. P. Pasternak U.S. Pat. No. 3,511,921. The base consists of an insulating material and functions to position and retain the wires to be interconnected. The contact is made of an electrically conductive metal having slots for each of the conductors to be spliced. The slots are of a configuration such that when the wire is forced into the slot, the insulation is pierced and the inside surfaces of the slot bear into the surface of the conductor. Consequently, a plurality of wires forced into respective slots of the contact will interconnect the wires. The cap is also made of an insulating material and is mated with the base to protect and insulate the splice.

In the noted prior patent 3,511,921 of Pasternak, the slots used in the contact had parallel inner walls culminating with a bottom wall perpendicular to the two parallel inner walls, thus forming two sharp corners. When a wire is forced into this slot, the stresses are focused on these corners. It has been realized that these corners have a tendency to tear or distort and under certain conditions cause the posts of the slot to lose their resiliency.

Another slot configuration used in the prior art is disclosed in J. P. Pasternak U. S. Pat. No. 3,718,888. This connector utilizes a pair of cantilevered posts for each wire to be connected. The adjacent sidewalls of each pair taper continuously together toward the fixed ends of the posts. It has now been determined that this slot has to be quite long relative to the height of the contact. Otherwise, the inner walls of the tapered slot will cut unduly into larger sized conductors and risk conductor weakening or breaking.

Furthermore, it is essential in posts of this type that they remain elastic in order to maintain efficient reliable contact with the wire conductor. Post configuration of the above-mentioned prior art would in certain instances evidence a small but still undesirable plastic deformation.

The base in the Pasternak U.S. Pat. No. 3,718,888 teaching has a plurality of adjacent openings for receiving the wires to be interconnected. The guidance which these openings provide is in some circumstances not as adequate as would be desired. Specifically, more than one wire could inadvertently be inserted into the same opening —which would, of course, prevent interconnection. Further, after the wires were inserted, but prior to effecting the splice, wires could possibly stray from their proper position and prevent the cover from mating with the base.

The prior art system of Pasternak 3,718,888 discloses basically passive reactions between the cap and the body to maintain conductor strain relief. But because there is a tendency of the cap to "rebound," the passive clamping action of the base and the cover is not always fully adequate.

SUMMARY OF THE INVENTION

In overcoming some of the prior art problems noted above, pursuant to one aspect of the invention, a wire contact element is provided which utilizes generally keyhole-shaped wire receiving slots. These slots can be made smaller than prior art designs and yet accommodate the same range of wire sizes. Also, the contact does not significantly warp or distort since stresses are distributed more evenly by virtue of the keyhole slot shape. Hence, elasticity of the contact is maintained and longevity of the connection is enhanced.

Another facet of the invention involves the adding of ribs to the base which form easy-to-use channels to guide the wires to be interconnected into retaining tunnels.

Pursuant to a further aspect of the invention, highly enhanced strain relief is achieved by adding bumpers on the cap which cooperate with fins that extend from the ribs of the base, to grip the wires more firmly. In a further embodiment, an offset gripping slot is provided for protecting the connection from torsional and tensional stresses.

The invention, its further features, objects, and advantages are more fully described in the following detailed description of the illustrative embodiment.

DESCRIPTION OF ILLUSTRATIVE EMBODIMENTS

Figure 1:
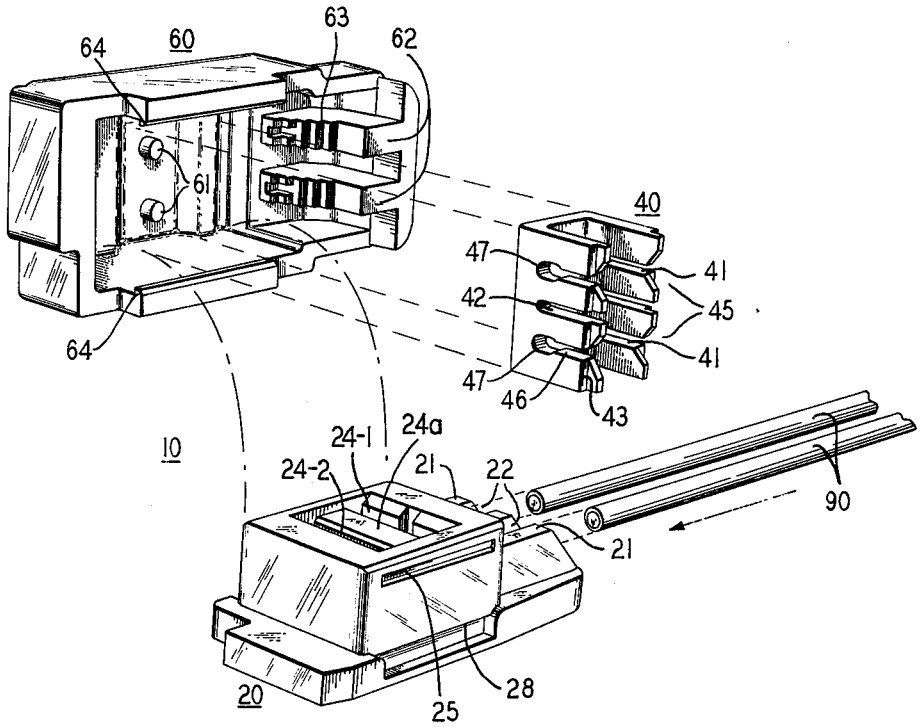
FIG. 1 is an exploded perspective view showing the elements of the connector.
Figure 2:
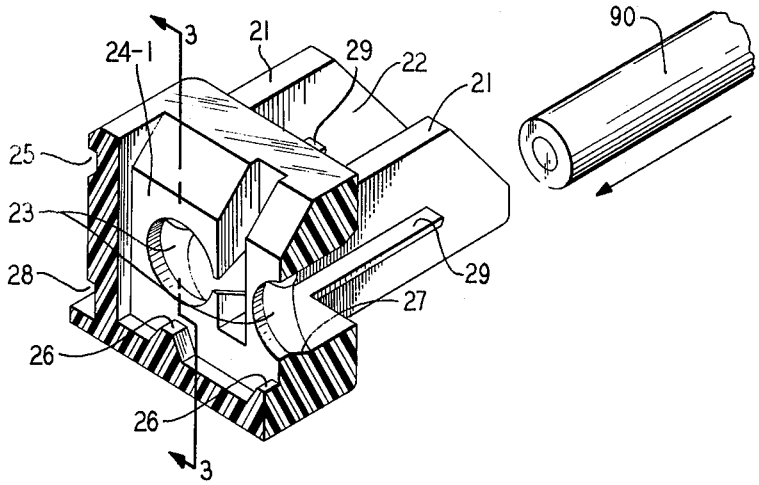
FIG. 2 is a partial section perspective view of the connector base.

The three basic components of the solderless connector denoted 10, consist of a base 20, a contact 40, and a cap 60 as depicted in FIG. 1. The base 20 is equipped with vertical rib extensions, for example, the three ribs 21. These, with associated wire-gripping means such as fin pairs 29 illustrated in FIGS. 2 and 8, form two channels 22.

Figure 3A:
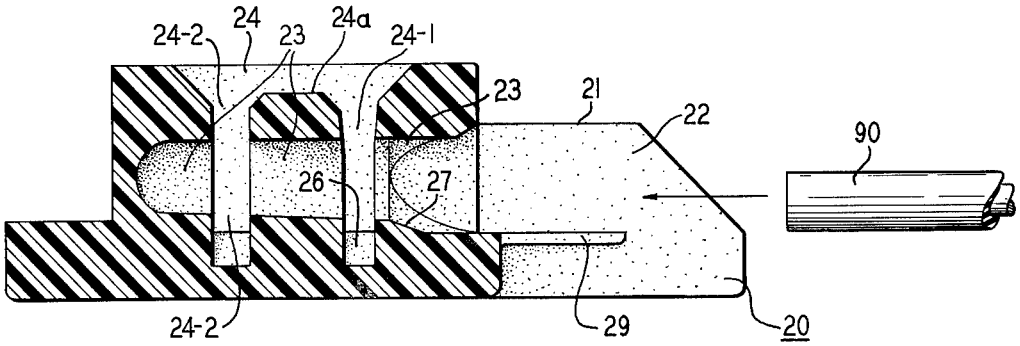
FIG. 3A is a cross section of the connector base showing the wire end prior to insertion.
Figure 3B:
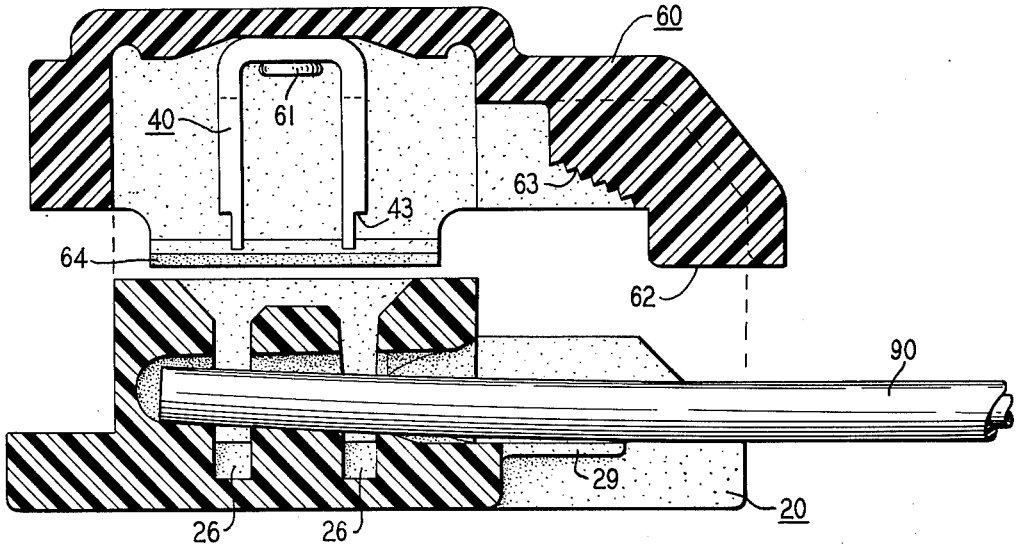
FIG. 3B is a partial cross section of the connector base and cap with the wire inserted into splicing position.
Figure 3C:
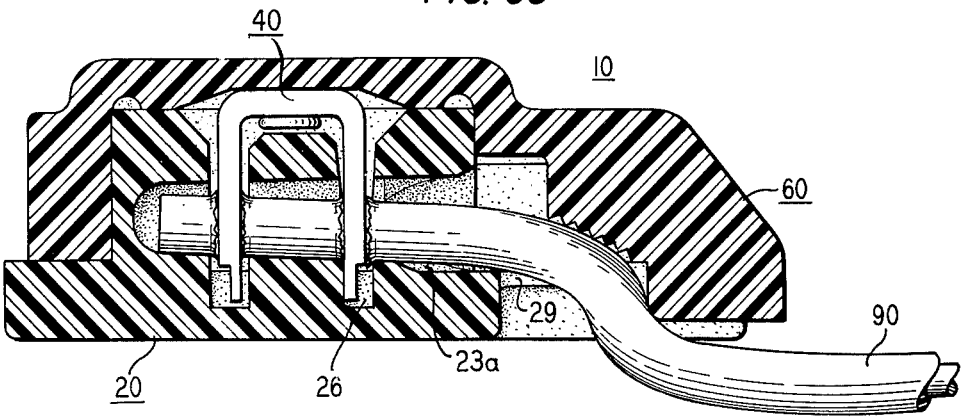
FIG. 3C is a partial cross section of the connector in a closed position with the splice implemented.

FIGS. 3A, 3B and 3C show assembly sequence. On insertion, a wire 90 is guided into a channel 22 aided by the entrance-flanking ribs 21. The wire then encounters ramp 27 seen in FIGS. 2 and 3A. The wire 90 passes through wire-receiving tunnels 23 until they touch the rear closed ends of the tunnels.

The base 20 interior has an interior chamber generally denoted 24, which includes a central riser 24-a. The tunnels 23 are formed in part through riser 24-a. The top of riser 24-a ends beneath the top edge of base 20.

Figure 8:
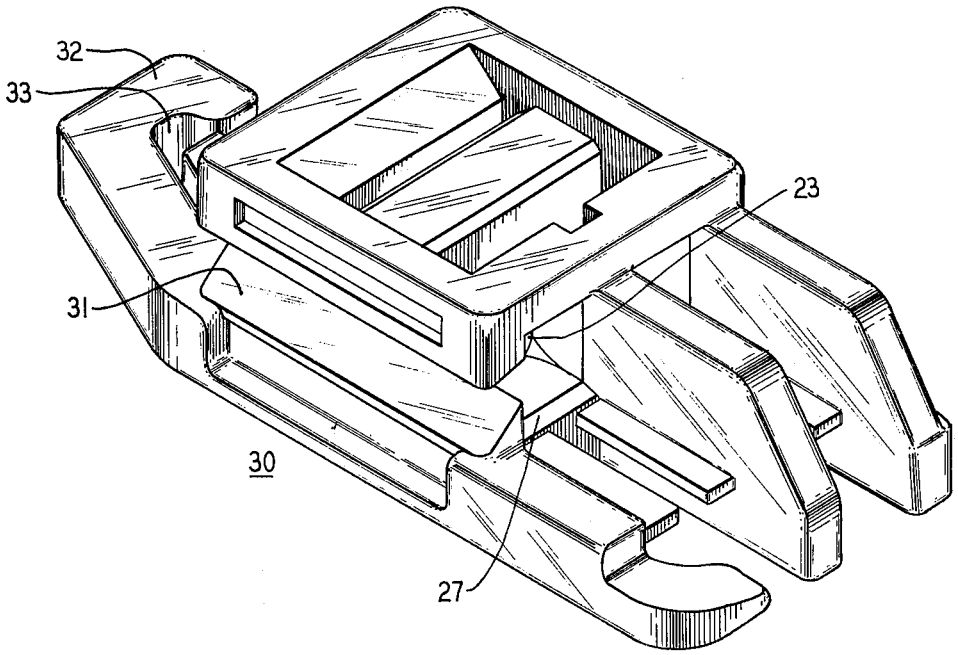
FIG. 8 is a perspective view of the base of the bridge-splice type connector.

Just within each tunnel opening, a ramp 27 is formed, so that the passage for the conductor leads upwardly to the level of the tunnel floor. In this distance, the passage makes a transition from rectangular at the entrance, as seen in FIG. 8, to circular at the first interruption point adjacent to the recess 24-1. The ramp 27 is contoured to the curvature of this transition zone.

Advantageously, because the ramp changes direction more rapidly than the associated wire, the space denoted 23a in FIG. 3C is created beneath the wire. Encapsulating sealant thus may be placed or provided within this space to provide an initial blocking medium against moisture seeking to enter the connector interior.

Figure 5:
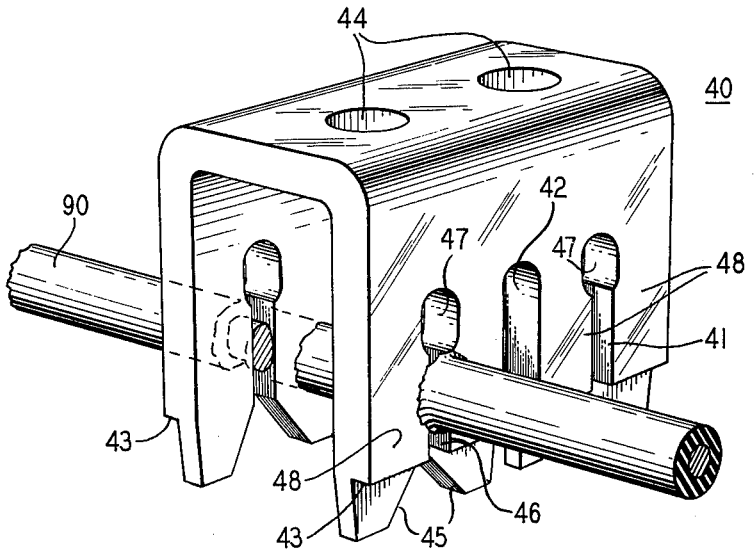
FIG. 5 is a perspective view of the contact of the connector showing a wire in its connected position.

The U-shaped contact 40 contained in cap 60 and depicted in FIG. 5 electrically interconnects two insulated conductors inserted into the body 20, by intersecting the tunnels and engaging each conductor in two separate places. Engagement is aided by anvil 26.

Contact 40 receives a given wire in two sets of jaws, each jaw set being defined by a pair of opposing posts 48. Each pair of posts 48 forms a wire slot 41 consisting of an open mouth entrance 45, which tapers to closely spaced and substantially parallel wire-contacting walls 46 and thereafter widens out in a bulbous configuration 47. The latter is smoothly contoured to have no sharp inside corners. The entire wire slot as defined is seen to have a keyhole shape.

Figure 4A:
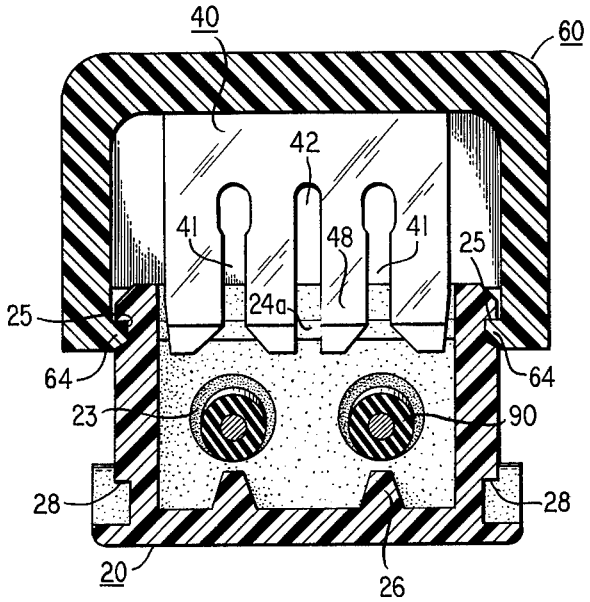
FIG. 4A is a cross section of the connector prior to the interconnection of the wires.
Figure 4B:
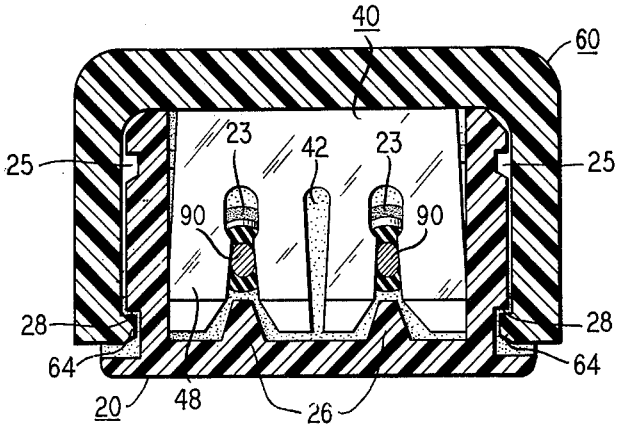
FIG. 4B is a cross section of the connector with the cap snap-locked to the base and the interconnection of the wire implemented.

As seen in FIGS. 4A and 4B, during insertion of the wire into the slot, the insulation is penetrated, pierced, and stripped away from the conductor, and the conductor penetrated by slot entrant details resulting in bearing contact of the inner walls of the slot on the conductor.

By virtue of the keyhole slot 41, stresses created by placement of wires between the walls 46 are more evenly distributed which helps minimize splitting or warping of the contact. Contact elasticity is thus maintained. The bulbous configuration 47 also permits maximizing the range of conductor sizes with a minimum length of the slot 41.

The central expansion slots 42 are substantially coextensive in length with the slots 41, and serve to further permit resilient movement of the posts 48 as they spread to accommodate a wire. Each post 48 has a shoulder 43 transverse to the walls 46 and located at the base of entrance 45. As seen in the sequence depicted in FIGS. 3A, 3B, 3C, the insulation is pierced and then shoulder 43 strips away insulation.

Cap 60, seen in FIGS. 1, 4A and 4B has two nubs 61 which mate with the holes 44 in contact 40, thus providing a means for indexing and subsequent fastening the contact to the cap. Grooves 25 are located on each side of the base 20 for loosely snap-fitting with inwardly extending tongues 64 of cap 60. This secures the cap to the base in an initial, ready-to-splice position as seen in FIG. 4A. In this position the contact posts 48 are noninterruptive with respect to the tunnels. Advantageously, the connector is supplied to the field with the body and cap in this position.

Once the wires 90 have been inserted into the body 20 the cap and body are pressed together. During this operation, a number of things take place. First, tongues 64 are forced out of the grooves 25. Next, the mouths 45 of the contact 40 pierce the insulation of the wires 90. The wires at this point yield downwardly a distance dependent on wire gauge size, and also on whether the wire is copper as illustrated in FIG. 4B, or aluminum. If aluminum, the wire will deflect significantly more, but not beyond the supporting anvils 26 which act as a secondary stuffing surface in that event. The anvils 26 in serving this purpose advantageously extend fully across the recesses as illustrated, but terminate in a flat top surface situated slightly below the floors of tunnels 23 — the distance being shown somewhat exaggerated for illustrative purposes. As the slots 41 move over the wires, the wide areas created by the shoulders 43 pierce and strip away the insulation, thus permitting the walls 46 to receive the bared conductors and yieldingly engage the surfaces thereof.

Figure 6:
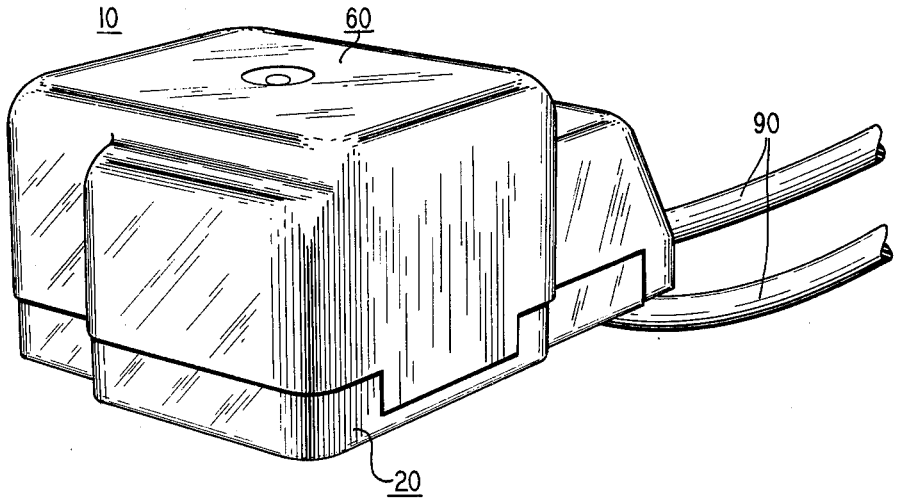
FIG. 6 is a perspective view of the butt-splice type connector.

Meanwhile, two bumpers 62 located on the underside of cap 60, as seen in FIGS. 3A, 3B, 3C, and equipped with staircase-shaped insulation contacting and gripping teeth 63 come in contact with the insulation. In the closed position, when the cap 60 and base 20 are mated, as in FIG. 4B, the bumpers 62 extend into the channels 22. The wires 90 are thereby forced or stuffed between yieldable members such as fin pairs 29 seen in FIGS. 2 and 8. The gripping teeth 63 now bear against wires 90 and the lower wire-contacting edge of bumpers 62 even further snubs and holds the wires down, as seen in FIG. 3C. This function pursuant to one aspect of the invention secures the wires and protects the splice from tensional and torsional stresses. The tongues 64 slide over retaining steps 28, advantageously with an audible click, indicating that the splice is effected. The cap 60 is now secured to the base 20, as seen in FIGS. 3C and 4B. The completed connection is shown in FIG. 6.

In order to minimize oxidation of aluminum conductors, it is advisable to include a globule of sealant, such as polyethylene-polybutene within the connector assembly to protect the connection from moisture and corrosive gases.

The above-illustrated embodiment accommodates a two-wire splice. However, the invention also contemplates connectors of the same wire-receiving and gripping configurations but with capacity extended to three or indeed many more, i.e., 100 wires. Here bridging between pairs or any adjacent two or more wires is achieved by expanding the contact element.

Figure 7:
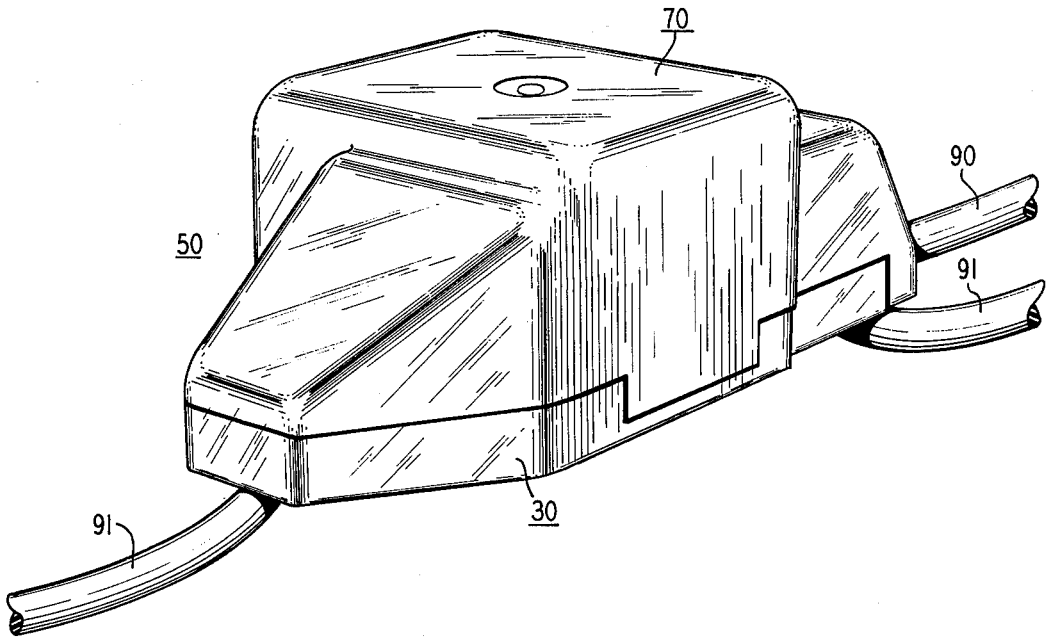
FIG. 7 is a perspective view of the bridge-splice type connector.

Practical experience has determined that approximately seventy-five percent of the usage of this type of connector is in two-wire butt splicing. As noted, the first embodiment relates to a two-wire butt splice connector. However, a bridge-splice version is depicted in FIGS. 7 and 8 as the connector 50. FIG. 8 indicates an angled slot 31 comprising an open wire-receiving side in the tunnel, which provides a means for inserting a continuous wire 91 into the connector body 30. An extension 32 is provided with a gripping slot 33 for securing the respective side of the wire and providing strain relief. This gripping area is offset from the wire and tunnel center line to prevent relative rotation of the connector with respect to the wire. The offset also makes it very difficult for a through wire to twist out of the slot 31 after insertion. The cap 70 of the connector 50 is so modified as to correspond with the extension 32 of the body 30.

The spirit of the invention is embraced in the scope of the claims to follow.

What is claimed is:

1. A connector for joining two or more insulated wires, comprising:

a base including wire-receiving tunnels each having an open entrance;

rib means flanking each said entrance and including wire-gripping means, the rib means and wire-gripping means defining a wire feed channel a contact element to interconnect wires in said tunnels; and a cap including means for mounting said contact element, means for engaging said base after said base and cap are pressingly closed to intersect said element with said tunnels, and means operative on said closing for stuffing wires present in respective said channels into said wire-gripping means.

2. A connector pursuant to claim 1, wherein said base includes an interior chamber having a central partition defining a recess on either side thereof, the mid-regions of each said tunnel being formed through said partition.

3. A connector pursuant to claim 2 wherein said contact element includes a u-shaped element comprising two pairs of opposing posts for gripping each wire received in each said tunnel, each post pair comprising converging thin entrance blades tapering to closely spaced and relatively thicker contacting walls, and an interor widened-out configuration having no internal corners.

4. A connector pursuant to claim 3 wherein each said post includes a shoulder running widthwise of said walls and disposed at the base of said entrance blades, said shoulder being formed at the juncture between said walls and said entrance blades.

5. A connector pursuant to claim 1, wherein said rib means are substantially parallel to each other, and said wire-gripping means each comprises an elongated slot adjacent to said tunnel open entrance defined by at least one yieldable member, and having a width narrower than the outside diameter of an insulated wire to be gripped therein.

6. A connector pursuant to claim 5 further comprising means for loosely fitting said cap on said base in an initial position with said contact element remotely positioned as to said tunnels.

7. A connector pursuant to claim 5 wherein said open entrance to each said tunnel further includes a ramp leading downwardly from the level of the tunnel floor.

8. A connector pursuant to claim 7 wherein said cap stuffing means further comprises a wire-contacting edge having insulation contacting teeth which when said cap is engaged on said base force the wire section adjacent to said entrance out of axial alignment with said tunnel and down into said wire gripping means.

9. A connector pursuant to claim 1, wherein one said tunnel further includes an open wire-receiving side through said base, and said base includes means offset from said one tunnel center line for gripping a wire placed through said open side into said one tunnel.

10. A connector pursuant to claim 2, further comprising wire-supporting anvils extending across said recesses parallel with, but below the floor level of, said tunnels.

11. A connector pursuant to claim 10, further comprising encapsulating material filling the interior voids within said cap and said base.

12. A connector comprising:

a cap and a body;

said body including at least two wire entrances formed between at least three protruding parallel fins adjacently joined by slotted webs, a wire lead-in ramp from each said entrance ending in a circular opening to an interior encapsulant-filled void, a depressed nub beyond each said opening midway across said void, further wire support means at the void far side, a wire when first placed across said support means being in noncontacting relation with the end of said nub and therefore being fully surrounded with said encapsulant;

said cap including slotted beam wire-bridging members, means for snap-mounting to said body, and means for snubbing inserted wires down between said fins and into said webs for strain relief.

* * * * *